US006866816B2

(12) United States Patent
Liang et al.

(10) Patent No.: US 6,866,816 B2
(45) Date of Patent: Mar. 15, 2005

(54) WEAR AND CORROSION RESISTANT AUSTENITIC IRON BASE ALLOY

(75) Inventors: Xuecheng Liang, Breen Bay, WI (US); Gary R. Strong, Menominee, MI (US)

(73) Assignee: Alloy Technology Solutions, Inc., Marinette, WI (US)

( * ) Notice: Subject to any disclaimer, the term of this patent is extended or adjusted under 35 U.S.C. 154(b) by 0 days.

(21) Appl. No.: 10/639,713

(22) Filed: Aug. 12, 2003

(65) Prior Publication Data

US 2004/0033154 A1 Feb. 19, 2004

Related U.S. Application Data

(60) Provisional application No. 60/403,937, filed on Aug. 16, 2002.

(51) Int. Cl.[7] ..... C22C 38/44; C22C 38/56; C22C 30/00

(52) U.S. Cl. ..... 420/12; 420/97; 420/98; 420/96; 420/101; 420/108; 420/109; 420/586.1; 148/324; 148/442; 75/246

(58) Field of Search ..... 148/324, 442; 420/108, 109, 101, 96, 97, 98, 12, 586.1; 75/246

(56) References Cited

U.S. PATENT DOCUMENTS

| | | | | |
|---|---|---|---|---|
| 3,257,178 | A | 6/1966 | Severns, Jr. | 29/194 |
| 3,410,732 | A | 11/1968 | Smith | 148/32 |
| 4,021,205 | A | 5/1977 | Matsuda et al. | 75/246 |
| 4,122,817 | A | 10/1978 | Matlock | 123/188 AA |
| 4,363,660 | A | 12/1982 | Wakita et al. | 75/128 |
| 4,929,419 | A | 5/1990 | Wegman et al. | 420/56 |
| 5,147,475 | A | 9/1992 | Holmberg | 148/327 |
| 5,194,221 | A | 3/1993 | Culling | 420/53 |
| 5,246,661 | A | 9/1993 | Culling | 420/12 |
| 5,292,382 | A | 3/1994 | Longo | 148/320 |
| 5,360,592 | A | 11/1994 | Culling | 420/582 |
| 5,458,703 | A | 10/1995 | Nakai | 148/503 |
| 5,674,449 | A | 10/1997 | Liang et al. | 420/12 |
| 6,200,688 | B1 | 3/2001 | Liang et al. | 428/544 |

FOREIGN PATENT DOCUMENTS

| | | |
|---|---|---|
| DE | 1023781 | 2/1958 |
| EP | 1108800 | 6/2001 |
| FR | 2835850 | 8/2003 |
| GB | 553397 | 5/1943 |
| GB | 741053 | 11/1955 |
| JP | 48052619 | 7/1973 |
| JP | 48102717 | 12/1973 |
| JP | 55-145156 | 11/1980 |
| JP | 57-203753 | 12/1982 |
| JP | 60-258449 | 12/1985 |
| JP | 02015149 | 1/1990 |
| JP | 02015150 | 1/1990 |

OTHER PUBLICATIONS

U.S. Appl. No. 10/074,068, filed Feb. 12, 2002 entitled "A Wear Resistant Alloy Containing Residual Austenite for Valve Seat Insert", 27 pages.

*Primary Examiner*—Deborah Yee
(74) *Attorney, Agent, or Firm*—Steven P. Shurtz; Brinks Hofer Gilson & Lione

(57) ABSTRACT

A unique austenitic iron base alloy for wear and corrosion resistant applications, characterized by its excellent sulfuric acid corrosion resistance and good sliding wear resistance, is useful for valve seat insert applications when corrosion resistance is required. The alloy comprises 0.7–2.4 wt % carbon, 1.5–4 wt % silicon, 3–9 wt % chromium, less than 6 wt % manganese, 5–20 wt % molybdenum and tungsten combined, with the tungsten comprising not more than ⅓ of the total, 0–4 wt % niobium and vanadium combined, 0–1.5 wt % titanium, 0.01–0.5 wt % aluminum, 12–25 wt % nickel, 0–3 wt % copper, and at least 45 wt % iron.

23 Claims, 2 Drawing Sheets

WEAR AND CORROSION RESISTANT AUSTENITIC IRON BASE ALLOY

REFERENCE TO EARLIER FILED APPLICATION

The present application claims the benefit of the filing date under 35 U.S.C. § 119 (e) of provisional U.S. Patent Application Ser. No. 60/403,937, filed Aug. 16, 2002, which is hereby incorporated by reference in its entirety.

BACKGROUND OF THE INVENTION

This invention relates to an austenitic iron base alloy, and in particular to such an alloy useful for making valve seat inserts used in internal combustion engines, with the novel combination of good wear and corrosion resistance under actual use conditions.

Modified M2 tool steel and Silichrome XB represent two common groups of casting iron base alloys used for diesel engine intake valve seat inserts. In broad ranges, modified M2 tool steel comprises 1.2–1.5 wt % carbon, 0.3–0.5 wt % silicon, 0.3–0.6 wt % manganese, 6.0–7.0 wt % molybdenum, 3.5–4.3 wt % chromium, 5.0–6.0 wt % tungsten, up to 1.0 wt % nickel, and the balance being iron. U.S. Pat. No. 5,674,449 discloses a high speed steel-type iron base alloy with excellent wear resistance as exhaust valve seat inserts.

Modified Silichrome XB contains 1.3–1.8 wt % carbon, 1.9–2.6 wt % silicon, 0.2–0.6 wt % manganese, 19.0–21.0 wt % chromium, 1.0–1.6 wt % nickel, and the balance being iron. Another high carbon and high chromium-type iron base alloy for intake valve seat inserts contains 1.8–2.3 wt % carbon, 1.8–2.1 wt % silicon, 0.2–0.6 wt % manganese, 2.0–2.5 wt % molybdenum, 33.0–35.0 wt % chromium, up to 1.0 wt % nickel, and the balance being substantially iron. There are also several high chromium-type iron base alloys available for making intake valve seat inserts.

High carbon and high chromium-type nickel base alloys, such as Eatonite 2, have excellent corrosion resistance and also good wear resistance as exhaust valve seat inserts. However, these nickel base alloys normally do not exhibit good wear resistance as intake valve seat inserts due to the lack of combustion deposits and oxides to reduce metal-to-metal wear. Eatonite is a trade name of Eaton Corporation. Eatonite 2 is a common nickel base alloy for exhaust valve seat inserts, which contains 2.0–2.8 wt % carbon, up to 1.0 wt % silicon, 27.0–31.0 wt % chromium, 14.0–16.0 wt % tungsten, up to 8.0 wt % iron, and the balance being essentially nickel. There are several nickel base alloys with added iron and/or cobalt for valve seat inserts. U.S. Pat. No. 6,200,688 discloses a high silicon and high iron-type nickel base alloy used as material for valve seat inserts.

Stellite® 3 and Tribaloy® T400[1] are two cobalt base alloys used as valve seat inserts for severe applications. U.S. Pat. Nos. 3,257,178 and 3,410,732 discuss such alloys. Tribaloy® T400 contains 2.0–2.6 wt % silicon, 7.5–8.5 wt % chromium, 26.5–29.5 wt % molybdenum, up to 0.08 wt % carbon, up to 1.50 wt % nickel, up to 1.5 wt % iron, and the balance being essentially cobalt. Stellite® 3 contains 2.3–2.7 wt % carbon, 11.0–14.0 wt % tungsten, 29.0–32.0 wt % chromium, up to 3.0 wt % nickel, up to 3.0 wt % iron, and the balance being cobalt. Stellite® and cobalt base Tribaloy® alloys offer both excellent corrosion and wear resistance. Unfortunately, these alloys are very expensive due to the high cost of the cobalt element.

[1] ®Registered Trademarks of Deloro Stellite Company Inc.

There are many powder metallurgy (PM) alloys available for making valve seat inserts. Here are a few examples in the PM alloys. Japanese Patent Publication No. 55-145,156 discloses an abrasion resistant sintered alloy for use in internal combustion engines which comprises 0.5 to 4.0 wt % carbon, 5.0 to 30.0 wt % chromium, 1.5 to 16.0 wt % niobium, 0.1 to 4.0 wt % molybdenum, 0.1 10.0 wt % nickel and 0.1 to 5.0 wt % phosphorus. Japanese Patent Publication No. 57-203,753 discloses an abrasion resistant sintered alloy containing 0.5–5 wt % carbon, 2–40 wt % of one or more of Cr, W, V, Nb, Ti, and B. Such a sintered alloy is melt-stuck by a means such as plasma, laser, or electron beam on a base material consisting of steel or cast iron. Japanese Patent Publication No. 60-258,449 discloses a sintered alloy for valve seat inserts. The alloy comprises 0.2–0.5 wt % carbon, 3–10 wt % molybdenum, 3–15 wt % cobalt, 3–15 wt % nickel, and the balance being iron.

Certain internal combustion engine valve alloys or valve facing alloys may also be classified into the same group of materials. U.S. Pat. No. 4,122,817 discloses an austenitic iron base alloy with good wear resistance, PbO corrosion and oxidation resistance. The alloy contains 1.4–2.0 wt % carbon, 4.0–6.0 wt % molybdenum, 0.1 to 1.0 wt % silicon, 8–13 wt % nickel, 20–26 wt % chromium, 0–3.0 wt % manganese, with the balance being iron. U.S. Pat. No. 4,929,419 discloses a heat, corrosion and wear resistant austenitic steel for internal combustion exhaust valves, which contains 0.35–1.5 wt % carbon, 3.0–10.0 wt % manganese, 18–28 wt % chromium, 3.0–10.0 wt % nickel, up to 2.0 wt % silicon, up to 0.1 wt % phosphorus, up to 0.05 wt % sulfur, up to 10.0 wt % molybdenum, up to 4.0 wt % vanadium, up to 8.0 wt % tungsten, up to 1.0 wt % niobium, up to 0.03 wt % boron, and the balance being essentially iron.

There are some corrosion resistant alloys that also relate to present invention. U.S. Pat. No. 4,021,205 discloses a heat and abrasion resistant sintered powdered ferrous alloy, containing 1 wt % to 4 wt % carbon, 10 to 30 wt % chromium, 2 to 15 wt % nickel, 10 to 30 wt % molybdenum, 20 to 40 wt % cobalt, 1 to 5 wt % niobium, and the balance iron. U.S. Pat. No. 4,363,660 discloses an iron base alloy having high erosion resistance to molten zinc attack consisting of 0.01–2 wt % carbon, 0.01 to 2 wt % silicon, 0.01–2 wt % manganese, 1–6 wt % niobium or tantalum, 1–10 wt % molybdenum or tungsten, 10–30 wt % nickel, 10–30 wt % cobalt, 10–25 wt % chromium, and a balance of iron and inevitable impurities. U.S. Pat. No. 5,194,221 discloses hot gas resistant alloys containing 0.85–1.4 wt % carbon, 0.2–2.5 wt % silicon, 0.2–4 wt % manganese, 23.5–35 wt % chromium, 0.2–1.8 wt % molybdenum, 7.5–18 wt % nickel, up to 1.5 wt % cobalt, 0.2–1.6 wt % tungsten, 0.1–1.6 wt % niobium, up to 0.6 wt % titanium, up to 0.4 wt % zirconium, up to 0.1 wt % boron, up to 0.7 wt % nitrogen, and iron being the balance.

Continuous efforts to improve the performance, durability, and emission of internal combustion engines have resulted in a demand for valve seat insert materials which can withstand the corrosive and high stress conditions of such engines. Internal combustion engines for marine applications or equipped with exhaust gas recirculation (EGR) systems not only require intake valve seat insert materials with excellent wear resistance, but also good corrosion resistance to resist the acid environment formed due to introduction of exhaust gas into the intake system. However, it is difficult for current casting iron base valve seat insert alloys to possess both good wear and corrosion resistance.

Therefore, it is the objective of this invention to develop an iron base alloy with both good corrosion and wear resistance to meet such requirements.

SUMMARY OF THE INVENTION

Austenitic iron base alloys have been invented that have good corrosion and wear resistance. The excellent wear resistance and good corrosion resistance of the inventive alloys are achieved through carefully controlling the amount of carbon, chromium, molybdenum, nickel, and silicon, etc. The alloys also have high sliding wear resistance and high hardness at elevated temperatures, and the cost of the alloys is significantly lower than commercially available cobalt base alloys, such as Stellite® and Tribaloy®. In one aspect, the present invention is an alloy with the following composition:

| Element | wt. % |
|---|---|
| Carbon | 0.7–2.4 |
| Silicon | 1.5–4 |
| Chromium | 3–9 |
| Molybdenum (or up to ⅓ of total Tungsten) | 5–20 |
| Nickel | 12–25 |
| Niobium or Vanadium | 0–4 |
| Titanium | 0–1.5 |
| Aluminum | 0.01–0.5 |
| Copper | 0–3 |
| Iron | at least 45 |

In another aspect of the invention, metal components are either made of the alloy, such as by casting, or by powder metallurgy methods, such as by forming from a powder and sintering. Furthermore, the alloy can be used to hardface other components with a protective coating.

DETAILED DESCRIPTION OF THE DRAWINGS AND PREFERRED EMBODIMENTS OF THE INVENTION

Figure 1:
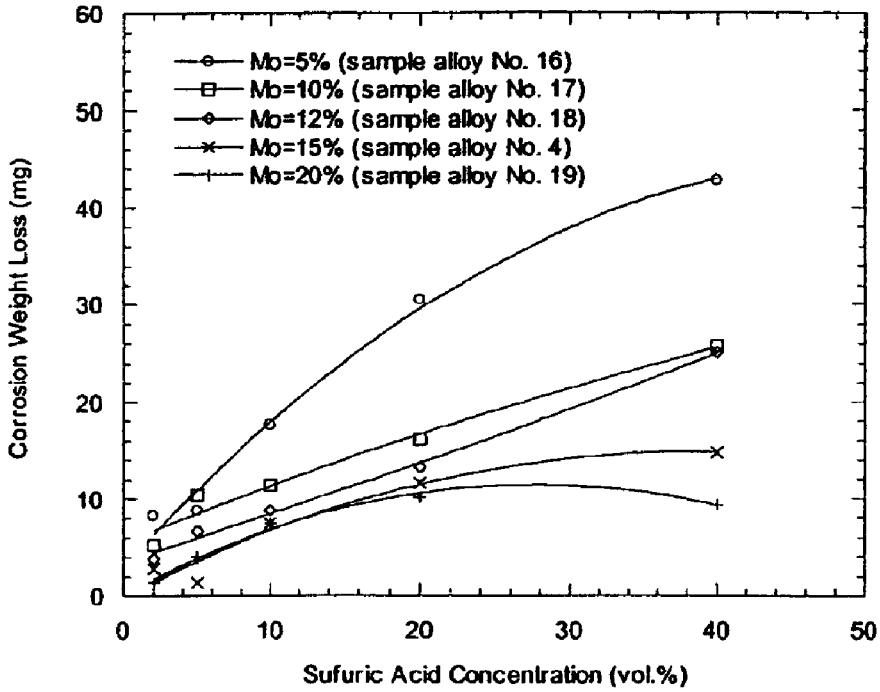
FIG. 1 is a graph showing the effects of molybdenum content on corrosion weight loss of sample alloys of the invention.

The unique feature of the inventive alloy is that the austenitic iron base alloys have both good corrosion resistance and wear resistance. This is especially useful as intake valve seat insert alloys for engines with corrosive environment. Unlike common M2 tool steel or Silichrome XB type intake insert alloys, the inventive austenitic iron base alloy was developed to improve both corrosion and wear resistance. Alloys resistant to sulfuric acid corrosion normally contain high chromium and high nickel alloy elements, like in AISI 300 series austenitic stainless steels or other higher grade of austenitic stainless steels where these alloys depend on electrochemical passivity for resistance to corrosion in sulfuric acid solution. However, high chromium-containing iron base alloys generally have poor frictional and wear characteristics, and high nickel content is harmful to galling resistance in iron base alloys. These two alloy elements contributing to good corrosion resistance thus have negative effects to wear resistance in iron base alloys. Thus, one important aspect of the present invention is to solve the technical dilemma of achieving good corrosion resistance and good wear resistance simultaneously in iron base alloys.

The inventive alloys contain a low to medium level of chromium for good friction and wear resistance, and the corrosion resistance to sulfuric acid is greatly enhanced by using a high molybdenum content and a medium level of nickel. Tests show that the addition of a small amount of copper is especially effective to further improve corrosion resistance. Addition of silicon offsets, to a certain amount, the adverse effect of chromium and nickel to sliding wear resistance, and also increases the corrosion resistance of the alloys. The formation of silicides in high silicon containing alloys reduces shear stress during sliding processes, therefore resulting in a better friction and wear behavior of the alloys. The negative effect of high molybdenum to wear resistance is solved by increasing the amount of carbon in the inventive alloys, and the corrosion resistance does not deteriorate if the amount of carbon is still within the specified range of the invention. A small amount of aluminum provides precipitation hardening properties in the inventive alloys During the development of this invention, a number of sample alloys were produced and tested. Sample alloys Nos. 1–8 contain 0.07–2.2 wt % C, 2.0 wt % Si, 0.4 wt % Mn, 5.0 wt % Cr, 12.0–15.0 wt % Mo, 12.0–20.0 wt % Ni, 0.3–0.7 wt % Ti, 0–2.0 wt Nb, 0.07–0.15 wt % Al, and the balance being iron with a small amount of impurities. Sample alloys No. 9–12 have compositions of 1.6 wt % C, 2.0 wt % Si, 0.4 wt % Mn, 3.0–15.0 wt % Cr, 15.0 wt % Mo, 16.0 wt % Ni, 0.3 wt % Ti, 2.0 wt % Nb, 0.07 wt % Al, and the balance being iron with a small amount of impurities. Sample alloys No.13–15 and 35 contain 1.6 wt % C, 1.0–2.5 wt % Si, 0.4 wt % Mn, 5.0 wt % Cr, 15.0 wt % Mo, 16.0 wt % Ni, 0.3 wt % Ti, 2.0 wt % Nb, 0.07 wt % Al, and the balance being iron with a small amount of impurities. Sample alloys No.16–19 contain 1.6 wt % C, 2.0 wt % Si, 0.4 wt % Mn, 5.0 wt % Cr, 5.0 to 20.0 wt % Mo, 16.0 wt % Ni, 0.3 wt % Ti, 2.0 wt % Nb, 0.07 wt % Al, and the balance being iron with a small amount of impurities. Sample alloys No. 20–22 contain 1.6 wt % C, 2.0 wt % Si, 0.4 wt % Mn, 5.0 wt % Cr, 15.0 wt % Mo, 12.0–25.0 wt % Ni, 0.3 wt % Ti, 2.0 wt % Nb, 0.07 wt % Al, and the balance being iron with a small amount of impurities. Sample alloys No. 23–25 contain 1.6 wt % C, 2.0 wt % Si, 0.4 wt % Mn, 5.0 wt % Cr, 15.0 wt % Mo, 16.0 wt % Ni, 0.3 wt % Ti, 0–2.0 wt % Nb, 0.07 wt % Al, 0–1.0 wt % Cu, and the balance being iron with a small amount of impurities. Sample alloys No. 26–29 contain 0.7–1.0 wt % C, 2.0 wt % Si, 0.4–12.0 wt % Mn, 5.0 wt % Cr, 15.0 wt % Mo, 0.0–20.0 wt % Ni, 0.7 wt % Ti, 0.15 wt % Al, and the balance being iron with a small amount of impurities. Sample alloys No. 30–32 contain 1.6 wt % C, 3.0–4.0 wt % Si, 0.4 wt % Mn, 9.0 wt % Cr, 15.0 wt % Mo, 16.0 wt % Ni, 0.1–0.3 wt % Ti, 0.5–1.5 wt % Nb, 0.07 wt % Al, and the balance being iron with a small amount of impurities.

Sample alloys No. 32–34 are commercially available alloys, and included as comparative samples.

Specimens of the above sample alloys were cast and machined for corrosion and wear tests. The nominal composition of all of these sample alloys is given in Table 1 below. The table is divided in sections with groups of alloys having common constituents in the same group, as discussed above. Sample No. 4 is listed in several places for purposes of comparison with other groups.

TABLE 1

| | Alloy Chemical Compositions (wt %) | | | | | | | | | |
|---|---|---|---|---|---|---|---|---|---|---|
| | C | Si | Mn | Cr | Mo | Fe | Ni | Ti | Nb | Al |
| Sample Alloy Number | | | | | | | | | | |
| 1 | 2.2 | 2.0 | 0.4 | 5.0 | 15.0 | Bal. | 16.0 | 0.3 | 2.0 | 0.07 |
| 2 | 2.0 | 2.0 | 0.4 | 5.0 | 15.0 | Bal. | 16.0 | 0.3 | 2.0 | 0.07 |
| 3 | 1.8 | 2.0 | 0.4 | 5.0 | 15.0 | Bal. | 16.0 | 0.3 | 2.0 | 0.07 |
| 4 | 1.6 | 2.0 | 0.4 | 5.0 | 15.0 | Bal. | 16.0 | 0.3 | 2.0 | 0.07 |
| 5 | 1.2 | 2.0 | 0.4 | 5.0 | 12.0 | Bal. | 16.0 | 0.3 | 0.5 | 0.07 |
| 6 | 1.1 | 2.0 | 0.4 | 5.0 | 15.0 | Bal. | 20.0 | 0.7 | — | 0.15 |
| 7 | 1.0 | 2.0 | 0.4 | 5.0 | 15.0 | Bal. | 12.0 | 0.7 | — | 0.15 |
| 8 | 0.7 | 2.0 | 0.4 | 5.0 | 15.0 | Bal. | 12.0 | 0.7 | — | 0.15 |
| 9 | 1.6 | 2.0 | 0.4 | 3.0 | 15.0 | Bal. | 16.0 | 0.3 | 2.0 | 0.07 |
| 4 | 1.6 | 2.0 | 0.4 | 5.0 | 15.0 | Bal. | 16.0 | 0.3 | 2.0 | 0.07 |
| 10 | 1.6 | 2.0 | 0.4 | 9.0 | 15.0 | Bal. | 16.0 | 0.3 | 2.0 | 0.07 |
| 11 (comparative) | 1.6 | 2.0 | 0.4 | 12.0 | 15.0 | Bal. | 16.0 | 0.3 | 2.0 | 0.07 |
| 12 (comparative) | 1.6 | 2.0 | 0.4 | 15.0 | 15.0 | Bal. | 16.0 | 0.3 | 2.0 | 0.07 |
| 13 (comparative) | 1.6 | 1.0 | 0.4 | 5.0 | 15.0 | Bal. | 16.0 | 0.3 | 2.0 | 0.07 |
| 14 | 1.6 | 1.5 | 0.4 | 5.0 | 15.0 | Bal. | 16.0 | 0.3 | 2.0 | 0.07 |
| 35 | 1.6 | 1.6 | 0.4 | 5.0 | 15.0 | Bal. | 16.0 | 0.3 | 2.0 | 0.07 |
| 4 | 1.6 | 2.0 | 0.4 | 5.0 | 15.0 | Bal. | 16.0 | 0.3 | 2.0 | 0.07 |
| 15 | 1.6 | 2.5 | 0.4 | 5.0 | 15.0 | Bal. | 16.0 | 0.3 | 2.0 | 0.07 |
| 16 | 1.6 | 2.0 | 0.4 | 5.0 | 5.0 | Bal. | 16.0 | 0.3 | 2.0 | 0.07 |
| 17 | 1.6 | 2.0 | 0.4 | 5.0 | 10.0 | Bal. | 16.0 | 0.3 | 2.0 | 0.07 |
| 18 | 1.6 | 2.0 | 0.4 | 5.0 | 12.0 | Bal. | 16.0 | 0.3 | 2.0 | 0.07 |
| 4 | 1.6 | 2.0 | 0.4 | 5.0 | 15.0 | Bal. | 16.0 | 0.3 | 2.0 | 0.07 |
| 19 | 1.6 | 2.0 | 0.4 | 5.0 | 20.0 | Bal. | 16.0 | 0.3 | 2.0 | 0.07 |
| 20 | 1.6 | 2.0 | 0.4 | 5.0 | 15.0 | Bal. | 12.0 | 0.3 | 2.0 | 0.07 |
| 4 | 1.6 | 2.0 | 0.4 | 5.0 | 15.0 | Bal. | 16.0 | 0.3 | 2.0 | 0.07 |
| 21 | 1.6 | 2.0 | 0.4 | 5.0 | 15.0 | Bal. | 20.0 | 0.3 | 2.0 | 0.07 |
| 22 | 1.6 | 2.0 | 0.4 | 5.0 | 15.0 | Bal. | 25.0 | 0.3 | 2.0 | 0.07 |
| 23 | 1.6 | 2.0 | 0.4 | 5.0 | 15.0 | Bal. | 16.0 | 0.3 | 0.0 | 0.07 |
| 24 | 1.6 | 2.0 | 0.4 | 5.0 | 15.0 | Bal. | 16.0 | 0.3 | 1.0 | 0.07 |
| 4 | 1.6 | 2.0 | 0.4 | 5.0 | 15.0 | Bal. | 16.0 | 0.3 | 2.0 | 0.07 |
| 25 | 1.6 | 2.0 | 0.4 | 5.0 | 15.0 | Bal. | 16.0 | 0.3 | 2.0 | 0.07 Cu:1.0 |
| 26 (comparative) | 1.0 | 2.0 | 12.0 | 5.0 | 15.0 | Bal. | — | 0.7 | — | 0.15 |
| 27 (comparative) | 0.7 | 2.0 | 6.0 | 5.0 | 15.0 | Bal. | 6.0 | 0.7 | — | 0.15 |
| 28 | 0.7 | 2.0 | 0.4 | 5.0 | 15.0 | Bal. | 12.0 | 0.7 | — | 0.15 |
| 29 | 0.7 | 2.0 | 0.4 | 5.0 | 15.0 | Bal. | 20.0 | 0.7 | — | 0.15 |
| 30 | 1.6 | 3.0 | 0.4 | 9.0 | 15.0 | Bal. | 16.0 | 0.1 | 1.5 | 0.07 |
| 31 | 1.6 | 4.0 | 0.4 | 9.0 | 15.0 | Bal. | 16.0 | 0.3 | 0.5 | 0.07 |
| Commercial Alloy Sample Number | | | | | | | | | | |
| 32 XB* | 1.5 | 2.4 | 0.5 | 20.0 | 0.2 | Bal. | 1.2 | — | — | — |
| 33 M2 | 1.6 | 1.3 | 0.50 | 4.0 | 6.5 | 79.1 | 5.5(W) | 1.5(V) | | |
| 34 S3** | 2.4 | — | 30 | 12.8(W) | 2.0 | 50.8 | 2.0 | | | |

XB*: Silichrome XB
S3**: Stellite ® 3

A high temperature pin-on-disk wear tester was used to measure the sliding wear resistance of the alloys because sliding wear is the common wear mode in valve seat insert wear. A pin specimen with dimensions of 6.35 mm diameter and approximate 25.4 mm long was made of Eatonite 6 valve alloy. Eatonite 6 was used as the pin alloy because it is a common valve facing alloy. Disks were made of sample alloys, each disk having dimensions of 50.8 mm and 12.5 mm in diameter and thickness respectively. The tests were performed at 500° F. (260° C.) in accordance with ASTM G99-90. The tests were performed on samples in an "as cast" condition without any heat treatment. Each disk was rotated at a velocity of 0.13 m/s for a total sliding distance of 255 m. The weight loss was measured on the disk samples after each test using a balance with 0.1 mg precision. Preferably the sample will have a wear loss of less than 200 mg, and more preferable less than 150 mg, when tested under these conditions. Disks of M2 tool steel, Silichrome XB, and Stellite® 3 were also made and tested as reference wear resistant alloys in the wear test. The results of the wear test are provided in Table 2 below.

TABLE 2

| Wear Test Results | | | |
|---|---|---|---|
| Sample Alloy | (Disk Weight Loss, mg) | Sample Alloy | (Disk Weight Loss, mg) |
| 1 (C 2.2%, Mo 15.0%) | 3.8 | 16 (Mo 5.0%) | 23.0 |
| 2 (C 2.0%, Mo 15.0%) | 7.3 | 17 (Mo 10.0%) | 50.3 |
| 3 (C 1.8%, Mo 15.0%) | 102.2 | 18 (Mo 12.0%) | 73.9 |
| 4 (C 1.6%, Mo 15.0%) | 138.8 | 4 (Mo 15.0%) | 138.8 |
| 5 (C 1.2%, Mo 12.0%) | 122.3 | 19 (Mo 20.0%) | 179.2 |
| 6 (C 1.1%, Mo 15.0%) | 207.0 | | |
| 7 (C 1.0%, Mo 15.0%) | 405.6 | 20 (Ni 12.0%) | 20.3 |
| 8 (C 0.7%, Mo 15.0%) | 474.2 | 4 (Ni 16.0%) | 138.8 |
| | | 21 (Ni 20.0%) | 170.1 |
| 9 (Cr 3.0%) | 65.5 | 22 (Ni 25.0%) | 367.4 |
| 4 (Cr 5.0%) | 138.8 | | |
| 10 (Cr 9.0% | 470.2 | 23 (Nb 0.0%) | 41.0 |
| 11 (Cr 12.0%) | 542.7 | 24 (Nb 1.0) | 81.1 |
| 12 (Cr 15.0%) | 667.5 | 4 (Nb 2.0%) | 138.8 |

TABLE 2-continued

| Sample Alloy | Wear Test Results (Disk Weight Loss, mg) | Sample Alloy | (Disk Weight Loss, mg) |
|---|---|---|---|
| 13 (Si 1.0%, Cr 5.0%) | 207.1 | | |
| 14 (Si 1.5%, Cr 5.0%) | 186.2 | | |
| 35 (Si 1.6%, Cr 5.0%) | 150.5 | 26 | 48.8 |
| 4 (Si 2.0%, Cr 5.0%) | 138.8 | 27 | 368.0 |
| 15 (Si 2.5%, Cr 5.0%) | 96.9 | 28 | 364.2 |
| 30 (Si 3.0%, Cr 9.0%) | 125.3 | 29 | 760.2 |
| 31 (Si 4.0%, Cr 9.0%) | 116.9 | | |
| | | 32 (XB) | 302.1 |
| 4 (Cu 0.0%) | 138.8 | 33 (M2) | 132.8 |
| 25Cu 1.0%) | 169.2 | 34 (Stellite 3) | 41.9 |

Figure 2:
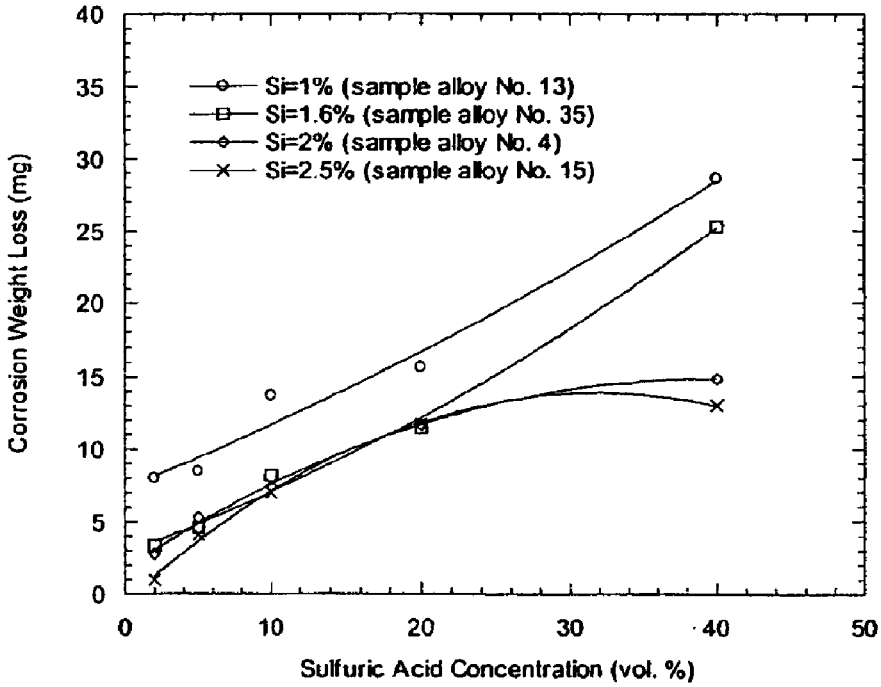
FIG. 2 is a graph showing the effects of silicon content on corrosion weight loss of sample alloys of the invention.
Figure 3:
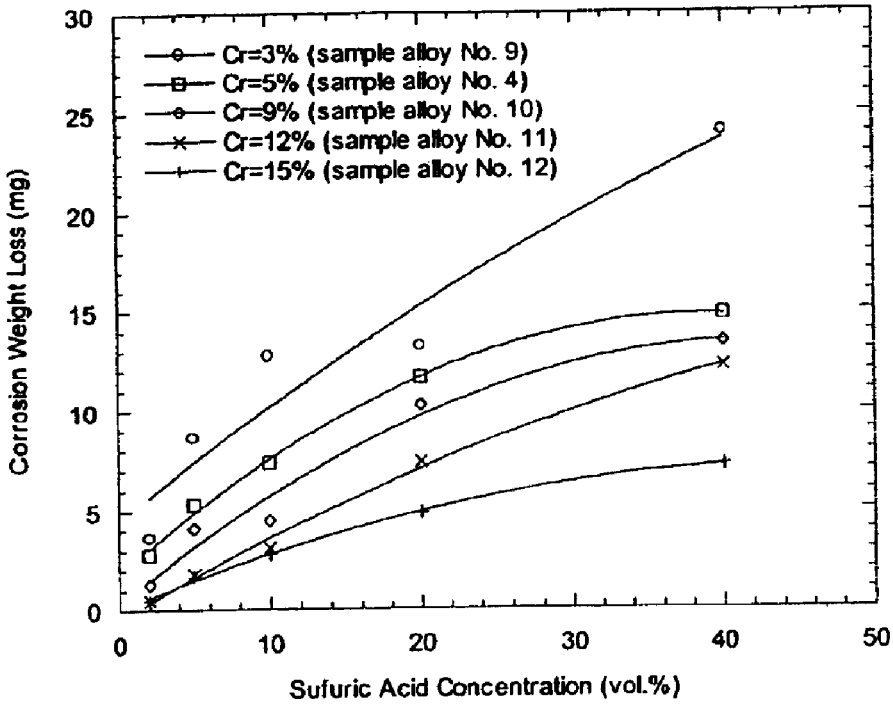
FIG. 3 is a graph showing the effects of chromium content on corrosion weight loss of sample alloys of the invention.
Figure 4:
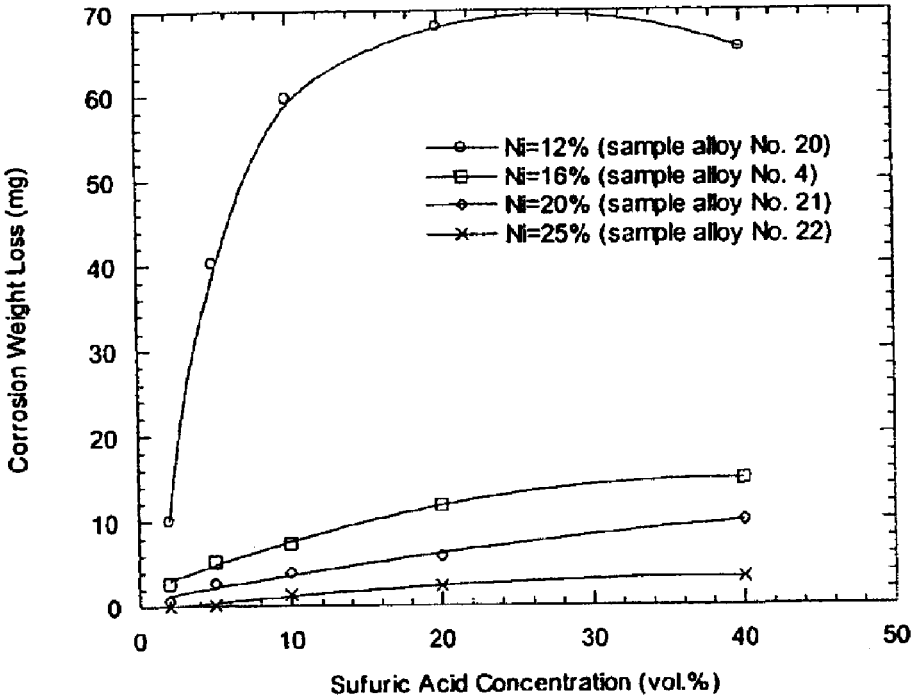
FIG. 4 is a graph showing the effects of nickel content on corrosion weight loss of sample alloys of the invention.

A corrosion test was also performed using 6.35 mm diameter and 25.4 mm long pin specimens. All pin specimens were immersed in 100 ml beakers containing 2.0 vol. %, 5.0 vol. %, 10.0 vol. %, 20.0 vol. %, and 40.0 vol. % sulfuric acid at room temperature for one hour. The corrosion pin samples were carefully cleaned and dried before and after each test. The weight loss was measured on the pin samples before and after each test using a balance with 0.1 mg precision. Preferably the sample will have a corrosion loss of less than 15 mg, and more preferable less than 10 mg, when tested with a 10% solution of sulfuric acid at room temperature for one hour. The results of the corrosion test are provided in Table 3 below and some of the results are shown graphically in FIGS. 1–4.

TABLE 3

Corrosion Test Results in Different Sulfuric Acid Solutions (Weight Loss, mg)

| Sample Alloy | (Sulfuric Acid Concentration) 2.0% | 5.0% | 10.0% | 20.0% | 40.0% |
|---|---|---|---|---|---|
| 1 (C 2.2%, Mo 15.0%) | 2.4 | 4.5 | 8.0 | 9.0 | 14.2 |
| 2 (C 2.0%, Mo 15.0%) | 3.4 | 7.6 | 9.0 | 11.7 | 14.1 |
| 3 (C 1.8%, Mo 15.0%) | 3.5 | 6.4 | 9.5 | 13.5 | 13.0 |
| 4 (C 1.6%, Mo 15.0%) | 2.8 | 5.3 | 7.4 | 11.7 | 14.8 |
| 5 (C 1.2%, Mo 12.0%) | 4.4 | 15.4 | 11.9 | 18.2 | 25.4 |
| 6 (C 1.1%, Mo 15.0%) | 0.5 | 4.7 | 4.8 | 7.9 | 13.8 |
| 7 (C 1.0%, Mo 15.0%) | 10.2 | 37.7 | 18.3 | 49.4 | 16.9 |
| 8 (C 0.7%, Mo 15.0%) | 14.1 | 379.2 | 29.8 | 70.1 | 62.6 |
| 9 (Cr 3.0%) | 3.6 | 8.6 | 12.8 | 13.2 | 24.0 |
| 4 (Cr 5.0%) | 2.8 | 5.3 | 7.4 | 11.7 | 14.8 |
| 10 (Cr 9.0%) | 1.3 | 4.1 | 4.5 | 10.3 | 13.4 |
| 11 (Cr 12.0%) | 0.5 | 1.8 | 3.1 | 7.4 | 12.2 |
| 12 (Cr 15.0%) | 0.5 | 1.7 | 2.8 | 4.9 | 7.2 |
| 13 (Si 1.0%, Cr 5.0%) | 8.0 | 8.5 | 13.7 | 15.6 | 28.6 |
| 14 (Si 1.5%, Cr 5.0%) | 4.3 | 6.5 | 10.4 | 14.8 | 21.9 |
| 35 (Si 1.6%, Cr 5.0%) | 3.3 | 4.6 | 8.2 | 11.5 | 25.3 |
| 4 (Si 2.0%, Cr 5.0%) | 2.8 | 5.3 | 7.4 | 11.7 | 14.8 |
| 15 (Si 2.5%, Cr 5.0%) | 1.0 | 4.1 | 7.0 | 11.8 | 13.0 |
| 30 (Si 3.0%, Cr 9.0%) | 1.6 | 4.3 | 5.1 | 8.2 | 11.0 |
| 31 (Si 4.0%, Cr 9.0%) | 0.8 | 4.9 | 5.0 | 8.7 | 10.4 |
| 16 (Mo 5.0%) | 8.2 | 8.7 | 17.6 | 30.5 | 42.8 |
| 17 (Mo 10.0%) | 5.2 | 10.4 | 11.4 | 16.1 | 25.8 |
| 18 (Mo 12.0%) | 3.8 | 6.6 | 8.8 | 13.3 | 25.2 |
| 4 (Mo 15.0%) | 2.8 | 5.3 | 7.4 | 11.7 | 14.8 |
| 19 (Mo 20.0%) | 1.4 | 4.0 | 7.4 | 10.2 | 9.4 |
| 20 (Ni 12.0%) | 10.0 | 40.2 | 59.7 | 68.1 | 65.6 |
| 4 (Ni 16.0%) | 2.8 | 5.3 | 7.4 | 11.7 | 14.8 |
| 21 (Ni 20.0%) | 0.7 | 2.8 | 4.0 | 5.8 | 9.9 |
| 22 (Ni 25.0%) | 0.0 | 0.2 | 1.4 | 2.3 | 3.3 |
| 23 (Nb 0.0%) | 1.4 | 5.2 | 7.3 | 12.6 | 17.1 |
| 24 (Nb 1.0%) | 1.2 | 5.0 | 6.6 | 11.3 | 18.8 |
| 4 (Nb 2.0%) | 2.8 | 5.3 | 7.4 | 11.7 | 14.8 |
| 25 (Cu: 1.0%) | 0.8 | 1.3 | 1.7 | 2.2 | 3.5 |

TABLE 3-continued

Corrosion Test Results in Different Sulfuric Acid Solutions (Weight Loss, mg)

| Sample Alloy | (Sulfuric Acid Concentration) 2.0% | 5.0% | 10.0% | 20.0% | 40.0% |
|---|---|---|---|---|---|
| 26 | 402.5 | 379.8 | 209.2 | 154.9 | 6.1 |
| 27 | 33.3 | 110.8 | 69.3 | 169.2 | 136.4 |
| 28 | 10.4 | 47.2 | 29.5 | 85.4 | 73.7 |
| 29 | 1.3 | 5.4 | 6.4 | 9.9 | 15.5 |
| 32 (XB) | 31.0 | 45.5 | 72.8 | 83.1 | 87.6 |
| 33 (M2) | 28.5 | 74.4 | 148.3 | 105.5 | 14.4 |
| 34 (Stellite 3) | 0.0 | 0.0 | 0.3 | 1.0 | 2.2 |

The ratio of carbon to carbide-forming alloy elements is important to achieve proper wear resistance. On the other hand, since one of the objectives of the inventive alloys is to achieve good corrosion resistance, several alloy elements, like, molybdenum, are present in higher amounts for this purpose. Some of these alloy elements form carbides. Therefore, carbon is a key element determining the wear resistance of the alloy. The effect of carbon on corrosion and wear resistance of the alloys are illustrated in sample alloys Nos. 1–8. Increasing the carbon content increases wear resistance when the carbon content changes from 0.7 to 2.2 wt %, except for sample alloy No. 5 with 1.2 wt % carbon, where the weight loss of the alloy from the wear test is lower than that of sample alloy No. 4 with 1.6 wt % carbon, because sample alloy No. 5 is the only one with 12.0 wt % molybdenum in this sample alloy group. A drastic change in wear resistance occurs when carbon content increases from 1.8 to 2.0 wt %, indicating that there is a certain relationship between carbon and total carbide-forming alloy elements.

Changing carbon content from 0.7 to 2.2 wt % does not have a significant effect on the corrosion resistance of the sample alloys, which is contradictory to general knowledge that carbon content should be controlled to minimum levels for the best corrosion resistance because of intergranular corrosion and depletion of alloy elements around carbide areas. Based on corrosion and wear test results, carbon in this alloy is between about 0.7 wt % and about 2.4 wt %, preferably between about 1.4 wt % and about 2.3 wt %, and more preferably between about 1.8 wt % and about 2.2 wt % for better wear resistance.

Chromium has different influences on the corrosion and wear resistance of the inventive alloys. Sample alloys Nos. 9–12 contain different amounts of chromium, ranging from 3.0 to 15.0 wt %. Increasing the chromium content increases the amount of weight loss in the wear test, while chromium increases corrosion resistance of the inventive alloys, as shown in Table 3. Therefore, chromium should be between about 3 wt % and about 9 wt %, preferably between about 3.5 wt % and about 6.5 wt %.

Silicon shows a beneficial effect to both corrosion and wear resistance of the inventive alloys, as shown in Tables 2 and 3. Increasing silicon content from 1.0 to 2.5 wt % improves wear resistance of the inventive alloys, but only marginal improvement in corrosion resistance in certain sulfuric acid concentrations. Higher silicon content will cause brittleness in castings made from the alloys. Therefore, silicon is between about 1.5 wt % and 4 wt %, preferably between about 1.6 wt % and about 3 wt %, and more preferably between about 1.8 wt % and 2.5 wt %.

Addition of nickel to the inventive alloys decreases wear resistance when nickel is in the range of 12.0 wt % to 25.0 wt % as in sample alloys No. 20–22. Especially when nickel changes from 12.0 to 16.0 wt % and from 20.0 to 25.0 wt %, there are sudden changes in wear resistance in the sample alloys. On the other hand, addition of nickel can effectively improve sulfuric acid corrosion resistance of the inventive alloys, especially when nickel increases from 12.0 to 16.0 wt %, the weight loss due to corrosion is reduced by several times. A minimum nickel content of about 12 wt % is required for a stable austenitic structure in the alloys, and the upper limit of nickel content in the alloys is about 25 wt %. The preferred nickel content range is between about 13 wt % and about 20 wt %, and more preferably between about 14 wt % and about 18 wt %

Molybdenum also has a similar effect like chromium in improving sulfuric acid corrosion resistance in the inventive alloys. Increasing the molybdenum content increases the corrosion resistance of the inventive alloys when molybdenum increases from 5.0 to 20 wt %. Significant change in corrosion resistance occurs when molybdenum increases from 5.0 to 10.0 wt %. Increasing molybdenum content in sample alloys Nos. 16–19 decreases the wear resistance of the inventive alloys. Lower carbon content in these samples may be a reason for the reduced wear resistance in higher molybdenum-containing sample alloys. Molybdenum ranges from about 5 wt % to about 20 wt % in the inventive alloys, preferably between about 10 wt % and about 19 wt %, and more preferably between about 12 wt % to about 18 wt %. While it has not been tested, it is believed that tungsten can be substituted for up to one third of the molybdenum used.

Niobium slightly improves the corrosion resistance of the inventive alloys as niobium content increases from zero to 2.0 wt % in sample alloys No. 23, 24, and 4. However, addition of niobium also causes a decrease in wear resistance in these sample alloys. This may be caused by the lower carbon content in the sample alloys. Niobium content in the inventive alloys should be between about 0 wt % and about 4 wt %, preferably between about 1 wt % and about 2.5 wt %. Vanadium may also be added to the alloy at a level of up to 4 wt % for better wear resistance.

The test results indicate that the addition of a small amount of copper can significantly improve the corrosion resistance of the inventive alloys. The weight loss due to corrosion of sample alloy No. 25 with 1.0 wt % copper is only a fraction of sample alloy No. 4 under higher sulfuric acid solutions, while the wear resistance of the copper containing sample alloy decreases moderately. Copper in the inventive alloys is in the range of about zero to about 4 wt %, preferably between about 0.5 and about 1.5 wt %.

High manganese content results in high corrosion weight loss as shown in sample alloys Nos. 26 and 27 with 12.0 and 6.0 wt % manganese, respectively. Therefore, manganese content in the inventive alloys should be less than 6 wt %, preferably between about 0.1 wt % and about 1 wt %, and more preferably between about 0.2 and about 0.6 wt %.

A small amount of aluminum, and optionally titanium, is added in the inventive alloys for precipitation hardening purpose. The range for aluminum is between about 0.01 and about 0.5 wt %, preferably between about 0.02 wt % and about 0.2 wt %, and more preferably between about 0.05 and about 0.1 wt %. The range for titanium is between about zero and about 1.5 wt %, preferably between about 0.05 wt % and about 0.5 wt %. When these elements are added, and the alloys heat treated, wear resistance will be improved.

Corrosion and wear test results for M2 tool steel, Silichrome XB, and Stellite 3 are also given in Table 2 and Table 3. It is clear that many inventive sample alloys have much better corrosion and wear resistance than M2 tool steel and Silichrome XB alloy. Some sample alloys are even close to Stellite 3 in terms of corrosion and wear resistance. However, these sample alloys are much less expensive than Stellite 3.

It should be appreciated that the alloys of the present invention are capable of being incorporated in the form of a variety of embodiments, only a few of which have been illustrated and described. The invention may be embodied in other forms without departing from its spirit or essential characteristics. It should be appreciated that the addition of some other ingredients, process steps, materials or components not specifically included will have an adverse impact on the present invention. The best mode of the invention may, therefore, exclude ingredients, process steps, materials or components other than those listed above for inclusion or use in the invention. However, the described embodiments are considered in all respects only as illustrative and not restrictive, and the scope of the invention is, therefore, indicated by the appended claims rather than by the foregoing description. All changes that come within the meaning and range of equivalency of the claims are to be embraced within their scope.

What is claimed is:

1. An austenitic iron base alloy, comprising:

a) about 0.7 to about 2.4 wt % carbon;

b) about 3 to about 9 wt % chromium;

c) about 1.5 to about 4 wt % silicon;

d) about 12 to about 25 wt % nickel;

e) about 10 about 20 wt % of molybdenum and tungsten combined, with the tungsten comprising up to ⅓ of the total molybdenum and tungsten;

f) about 0 to about 4 wt % niobium and vanadium combined;

g) about 0 to about 1.5 wt % titanium;

h) about 0.01 to about 0.5 wt % aluminum;

i) about 0 to about 3 wt % copper;

j) less than 6 wt % manganese;

g) at least 45 wt % iron.

2. A part for internal combustion engine component comprising the alloy of claim 1.

3. The part of claim 2 where the part is formed by casting the alloy, hardfacing with the alloy either in wire or powder form, or the part is formed by a powder metallurgy method.

4. The alloy of claim 1 wherein the amount of carbon is between about 1.8 and about 2.2 wt %.

5. The alloy of claim 1 wherein the amount of chromium is between about 3.5 and about 6.5 wt %.

6. The alloy of claim 1 wherein the amount of silicon is between about 2 and about 3 wt %.

7. The alloy of claim 1 wherein the amount of molybdenum and tungsten combined is between about 12 and about 18 wt %.

8. The alloy of claim 1 wherein the amount of nickel is between about 14 and about 18 wt %.

9. The alloy of claim 1 wherein the amount of niobium and vanadium combined is between about 1.5 and about 2.5 wt %.

10. The alloy of claim 1 wherein the amount of titanium is between about 0.1 and about 0.5 wt %.

11. The alloy of claim 1 wherein the amount of aluminum is between about 0.02 and about 0.2 wt %.

12. The alloy of claim 1 wherein the amount of copper is between about 0.5 and about 1.5 wt %.

13. The alloy of claim 1 wherein the amount of manganese is between about 0.1 and about 1 wt %.

14. The alloy of claim 1 wherein the amount of iron is greater than about 50 wt %.

15. The alloy of claim 1 wherein the alloy has a corrosion loss of less than 15 mg when a cylindrical sample of the alloy having a diameter of 6.55 mm and a length of 25.4 mm is immersed in a 10 volume % solution of sulfuric acid at room temperature for 1 hour.

16. The alloy of claim 1 wherein the alloy has a high temperature pin-on-disk disk wear loss of less than 200 mg when tested under ASTM G99-90 test conditions at 500° F. with a pin of Eatonite 6 valve alloy having a diameter of 6.35 mm and a length of 25.4 mm held against a rotating disc of the alloy 50.8 mm in diameter and 12.5 mm thick at a velocity of 0.13 m/s for a total sliding distance of 255 m.

17. An austenitic iron base alloy with good corrosion and wear resistance, comprising:

a) about 1.4 to about 2.3 wt % carbon;

b) about 3 to about 9 wt % chromium;

c) about 1.6 to about 3 wt % silicon;

d) about 13 to about 20 wt % nickel;

e) about 10 to about 19 wt % of molybdenum and tungsten combined, with the tungsten comprising up to ⅓ of the total molybdenum and tungsten;

f) about 1 to about 2.5 wt % niobium and vanadium combined;

g) about 0.05 to about 0.5 wt % titanium;

h) about 0.02 to about 0.2 wt % aluminum;

i) about 0 to about 3 wt % copper;

j) about 0.1 to about 1 wt % manganese;

g) at least 50 wt % iron.

18. A part for an internal combustion engine component comprising the alloy of claim 17.

19. The alloy of claim 1 wherein the alloy is homogeneous.

20. The alloy of claim 17 wherein the alloy is homogeneous.

21. The alloy of claim 1 wherein the amount of niobium is at least 0.5 wt %.

22. The alloy of claim 1 wherein the alloy has a corrosion loss of less than 10 mg when a cylindrical sample of the alloy having a diameter of 6.55 mm and a length of 25.4 mm is immersed in a 10 volume % solution of sulturic acid at room temperature for 1 hour.

23. The alloy of claim 1 wherein the amount of chromium is between about 5 and about 9 wt %.

* * * * *